United States Patent [19]

Staufert et al.

[11] 4,245,460

[45] Jan. 20, 1981

[54] OPEN-END SPINNING UNIT

[75] Inventors: Helmut Staufert, Holbeinweg 40, 7000 Stuttgart 1, Fed. Rep. of Germany; Fritz Stahlecker, Bad Überkingen, Fed. Rep. of Germany

[73] Assignee: Helmut Staufert, Fed. Rep. of Germany

[21] Appl. No.: 16,874

[22] Filed: Mar. 2, 1979

[30] Foreign Application Priority Data

Mar. 2, 1978 [DE] Fed. Rep. of Germany ..... 2809008

[51] Int. Cl.[3] ..... D01H 7/882

[52] U.S. Cl. ..... 57/58.89

[58] Field of Search ..... 57/300, 301, 302, 58.89–58.91–58.99

[56] References Cited

U.S. PATENT DOCUMENTS

| | | | |
|---|---|---|---|
| 3,845,612 | 11/1974 | Chisholm et al. | 57/58.89 X |
| 3,859,779 | 1/1975 | Furstenberg | 57/58.89 X |
| 3,999,365 | 12/1976 | Suzuki et al. | 57/58.89 X |
| 4,058,963 | 11/1977 | Stahlecker | 57/58.89 X |
| 4,109,451 | 9/1978 | Yamada et al. | 57/58.89 X |
| 4,166,356 | 9/1979 | Chrtek et al. | 57/58.89 |

*Primary Examiner*—Donald Watkins

*Attorney, Agent, or Firm*—Craig & Antonelli

[57] ABSTRACT

An open-end spinning unit is provided which has a spinning rotor open on one side and has a closed bottom and lateral sides. A closing component covers the open side of the rotor and includes a fiber supply duct directed at a slide wall part of the lateral wall of the rotor, a yarn take-off duct, and a suction duct. To optimize the air conveyance of fiber to the slide walls, at least a part of the suction duct orifice is disposed in the radial direction of the rotor closer to the slide wall than to the orifice of the fiber supply duct.

31 Claims, 16 Drawing Figures

58
59
60
28E
1E
38E
37E
29E
30E
61
39E
2E
12E
11E
40E
62
55
56
57

OPEN-END SPINNING UNIT

BACKGROUND AND SUMMARY OF THE INVENTION

The invention relates to an open-end spinning unit with a spinning rotor open on one side and having a closed bottom and closed lateral walls, the open side of which spinning rotor is covered with a closing component containing fiber supply means directed at a slide wall of the spinning rotor, a yarn take-off duct, and a suction duct.

In open-end spinning units the loosened fibers are transported to the spinning rotor with the aid of a stream of air leading from an opening roll to the spinning rotor. In order to produce the stream of air, subatmospheric pressure must be generated in the area inside of the spinning rotor.

It has been known (DOS [German Unexamined Published Application] 1,560,333) to provide the rotor walls with ventilation bores and to arrange the spinning rotor inside of a rotor housing connected to a source of subatmospheric pressure. In this structure the subatmospheric pressure prevailing in the rotor is caused by the spinning rotor itself and by an external indraft source. In this construction, the spinning rotor edge bordering the open lateral face is sealed off with a sealing gap against a fixed housing insert. This insert is then covered once again with a cap having an insert projecting into the spinning rotor. Further, there must be an additional seal at the point at which a shaft of the spinning rotor penetrates the rear wall of the rotor housing. The fact that it is not possible, prior to a piecing operation, to simply free the spinning rotor of fiber remains or the like by drawing them off by suction is unfavorable in this construction. Instead, the spinning unit must be opened so that the rotor is accessible.

It has also been known (DOS 1,710,026) to provide spinning rotors with closed lateral walls and a closed bottom, which walls and bottom are arranged in a rotor housing connected to a source of subatmospheric pressure in such a way that, proceeding from a fiber supply duct, air flows from the rotor interior by way of the edge of the open side to the rotor housing and from there flows to the suction connection. This structure then opens up the possibility of drawing off fibers or the like from the rotor interior by suction when the rotor is at a standstill. However, this construction entails the difficulty that the subatmospheric pressure prevailing in the interior chamber of the rotor and also the velocity of the air flowing over the rotor edge are dependent on the dimensions of the spinning rotor and the rotor housing, so that in practice problems arise in using rotors of different sizes on the basis of this principle.

It has likewise been known (DOS 1,710,715) to attach a suction duct directly to the rotor interior from a spinning rotor in which the spun yarn is discharged through the hollow shaft. This construction provides a structural part extending into the spinning rotor with a cylindrical hub-shaped attachment having an orifice of a fiber supply duct on its lateral face. The middle section of this structural part is formed as a suction duct with a large cross section.

Further, it has been known (DOS 2,308,707, FIG. 2) to equip a closing member for a rotor housing receiving a spinning rotor with an annular suction duct in the middle section. In this construction, a fiber supply duct terminates in the end face of the closing member in such a way that the orifice of this fiber supply duct is located radially further out than the orifice of the middle suction duct.

In another construction using this basic principle (DAS [German Published Application] 2,130,723) the spinning rotor is also arranged in a closed rotor housing. In this structure, the fiber is supplied by way of a fiber supply duct terminating inside of an annular groove formed between the end surface of a hub-like component projecting into the spinning rotor and a fiber guide shield arranged concentrically with respect to the rotor axle. A suction duct which will take in air with a high air velocity leads through said annular groove to the external face of the fiber guide shield.

A common aspect of all of the constructions in which the transport air is drawn in by suction directly from the rotor via the closing component is that the orifice of the suction duct maintains a greater spacing with respect to the interior walls of the spinning rotor than do the orifice of the fiber supply duct or the edges of the fiber guide disks. This results in the deflection of the transport air to the suction duct directly after leaving the fiber guide means, i.e. the fiber supply duct or the fiber guide shield. The danger exists that thereby a considerable portion of the transported fibers are taken in directly via the suction duct and do not reach the fiber slide surface of the spinning rotor. In all of these constructions the orifice of the yarn take-off duct is also located in very close proximity to the orifice of the suction duct, so that the piecing process is made extremely difficult. For, in order to piece a thread, a thread end must be returned via the yarn take-off duct so far into the spinning rotor that the thread end attaches to a fiber ring deposited in the spinning rotor and can be pieced. In the conventional constructions there exists the danger that the thread end is prematurely taken into the suction duct before it can reach the area of the collecting groove of the spinning rotor, so that piecing is impossible. The difficulties described are probably the reason that these structures have not entered practice.

It is an object of the invention to construct an open-end spinning unit of the type named hereinabove in such a way that the subatmospheric pressure necessary for fiber transport can be produced with uniform magnitude in the interior of the spinning rotor on all spinning units of an open-end spinning machine with a minimal energy requirement and that the fibers are transported reliably to the fiber-collecting groove of the spinning rotor without the occurrence of rather large fiber losses due to air intake and without significant complications to the piecing operation. This problem is solved in that the orifice of the suction duct is located, at least partially—in a radial direction with respect to the spinning rotor—closer to the slide wall of the spinning rotor than the fiber supply means.

This construction achieves the fact that the fibers exiting from the fiber supply means are seized by an air current having a flow component directed toward the slide wall of the spinning rotor, thus increasing the reliability that all of the fibers reach this slide wall. Once the fibers have reached the slide wall of the spinning rotor, then the frictional force between the fibers and the very rapidly rotating spinning rotor is greater than the entraining force of the air current, so that the fibers are not removed by way of the suction duct.

In an expedient preferred embodiment of the invention, it is provided that the orifice of the suction duct—in an axial direction of the spinning rotor—is located closer to the open lateral face of the spinning rotor than the fiber supplying means. This embodiment generates an axial air current inside of the spinning rotor in the direction toward the open end of the spinning rotor; this axial air current further increases the chances of the fibers of also really reaching the slide wall of the spinning rotor. In this connection, it can be seen as especially advantageous that the slide wall of the spinning rotor conically tapers toward the open end of the spinning rotor. The air flowing in the spinning rotor is also entrained in a peripheral direction by the spinning rotor, so that there results an air whorl, flowing toward the orifice of the suction duct, within which air whorl the fibers being carried forward move outwardly so that they reliably contact the slide wall of the spinning rotor.

In order to achieve to an even greater extent that the air current occurring inside of the spinning rotor is closely adapted to the interior walls of the rotor, it is advantageously provided that the suction duct—seen in the plan view of the open lateral face of the spinning rotor—extends at least nearly tangentially with respect to the spinning rotor.

In another embodiment of the invention it is provided that the orifice of the suction duct partially overlaps the edge of the open lateral face of the spinning rotor. Thus it is attained that the air current directed toward the suction duct moves very closely along the slide wall of the spinning rotor, thus further improving the depositing of the fibers.

In a further embodiment of the invention it is provided that the orifice of the suction duct is equipped with covers which adjust the orifice cross section preferably in the manner of a diaphragm. Thus the intensity of the air current inside of the spinning rotor can be influenced. According to yet further embodiments of the invention, it can also be provided that the orifice cross section is decreased for a piecing process, so that the danger can thus be likewise even further reduced that the thread end to be returned into the spinning rotor is taken into the suction duct before reaching the fiber-collecting surface of the spinning rotor.

In another embodiment of the invention it is provided that the closing component is capable of being moved away from the spinning rotor with the aid of guide elements. It is thereby possible to expose the spinning rotor for examination or maintenance or the like. In this connection, the suction duct can be connected to an exhaust air duct of the spinning unit with an elastic hose. The connection to the exhaust air duct is consequently uninterrupted. In another embodiment of the invention it is provided that the suction duct of the closing component, which former is capable of being moved with the closing component, is attached to the exhaust air duct by means of a readily detachable connection. Thus it is possible to separate the suction duct from the exhaust air duct when the closing component is removed from the area of the spinning rotor. In this case, for instance, a mobile service apparatus can then be joined to this exhaust air duct, so that the means, belonging to the machine, for producing an indraft current can be attached to the service apparatus; thus the latter does not require any indraft source of its own.

In a further embodiment of the invention it is provided that the closing component together with the edge of the open lateral face of the spinning rotor forms a sealing gap. Such a construction precludes any further enclosing of the spinning rotor, i.e. the spinning rotor can be arranged completely free and without any surrounding rotor housing. This results in advantages, especially in open-end spinning machines in which the spinning rotor is mounted in an indirect bearing above its shaft, particularly in a bearing comprised of supporting disks and an axial bearing. Since a housing is omitted, the spinning rotor can then be mounted by the supporting disks in relatively close proximity to the rotor plate. In this way, the effect of imbalances is substantially reduced. Besides, the area of the bearing is very easily accessible for service and repair work.

In order to facilitate the piecing operation, it is provided in a further embodiment of the invention that a preferably adjustable thread guide element, which partially covers the orifice of the suction duct, is arranged between the orifice of the suction duct and the yarn take-off duct. This thread guide element reliably guides the thread via the area of the orifice of the suction duct without substantially affecting the occurring air current.

Also for facilitating the piecing process and for preventing the thread end from being drawn in by suction, it is provided in another embodiment of the invention that the suction duct is equipped with means for reducing the amount of air intake. This can take place, for example, by compressing the elastic hose between the suction duct and an exhaust air duct of the spinning unit, so that the duct cross section is reduced.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
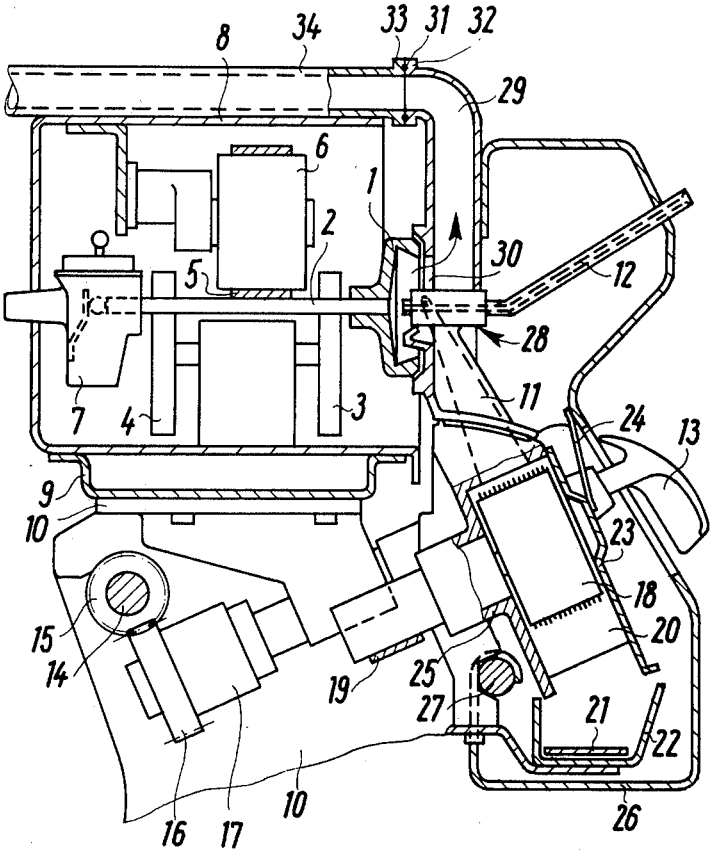
FIG. 1 is a schematic sectional view through a portion of an open-end spinning machine and showing a spinning unit constructed in accordance with a preferred embodiment of the present invention, in a closed condition.

FIG. 1 represents an open-end spinning unit which forms an open-end spinning machine with a multitude of identical spinning units arranged next to each other. Each spinning unit contains a spinning rotor 1 which is radially mounted with a shaft 2 in wedge-shaped gaps formed by the pairs of supporting disks 3 and 4. The shaft 2 is driven directly by a tangential belt 5 stressed in the area of the rotor shafts 2 with contact rollers 6 on which the backward traveling side of the tangential belt is returned. An axial force is exerted on the rotor shaft 2, which axial force is especially maintained by a skew arrangement of the axles of the pairs of supporting disks 3 and 4. The shaft 2 supports itself with its end on a footstep bearing 7 against this axial force. The rotor 1 and its shaft and the attached bearing and drive elements are mounted in a duct traversing in the longitudinal direction of the machine; which duct is formed from a C-shaped profile 8 which can be a sheet metal profile or, preferably, an extruded profile. The spinning rotor and its bearing and drive elements are arranged inside of the C-shaped duct in such a way that the spinning rotor comes to be located in the area of the open lateral face of the duct. The profile 8 is mounted with a supporting profile 9 on machine plates 10.

The spinning rotor is supplied with fiber material loosened to individual fibers by way of a fiber supply duct 11. In the spinning rotor 1 this fiber material is spun into a thread which is taken off by way of a yarn take-off duct 12 starting coaxially with respect to the shaft 2 of the spinning rotor 1.

The fiber material is supplied to a feed roll, not shown, via an inlet funnel 13; this feed roll operates in conjunction with a clamping trough. The feed roll is driven by a shaft 14 traversing in the longitudinal direction of the machine by way of gear wheels 15 and 16, wherein the shaft leading to the feed roll is connected to the gear wheel 16 via an electromagnetic coupling or clutch 17 which opens when the thread breaks and consequently interrupts the supply of fiber material.

The fiber material supplied by the feed roll and a feed table is fed to an opening roll 18 which has fittings of teeth or needles and which combs out the fiber material and loosens it to individual fibers. The fiber material is removed from the opening roll 18 at the beginning of the fiber supply duct 11 and fed to the spinning rotor 1. The opening roll 18 is driven by a tangential belt 19 traversing in the longitudinal direction of the machine; the returning side of this tangential belt is not depicted.

Located in the peripheral area of the opening roll 18 is a separation aperture 20 for impurities; associated with this separation aperture is a transport belt 21 located below it and conveyed in a trough-like guide profile 22.

The area of the feed roll and the opening roll 18 is covered with a sheet metal cap 23 which is pressed to the housing 25 of the opening roll 18 by means of a spring 24. The area of the opening roll 18 and the feed roll as well as the transport belt 21 is concealed with a cover 26 which is associated respectively with one individual spinning unit. This cover 26, consisting, for instance, of a sheet metal profile, is pivotable about an axle 27. A closing component 28 containing a section of the fiber supply duct 11, which extends from the housing 25 of the opening roll to the area of the spinning rotor, is fastened to the cover 26. Besides this section of the fiber supply duct 11, the closing component 28 contains the thread take-off duct and a suction duct 29. The closing component 28 seals the spinning rotor 1, having closed lateral walls and a closed bottom, with a sealing gap on its open lateral end face. The suction duct 29 is provided with an orifice 30 which is open toward the spinning rotor 1 and which slightly extends radially beyond the external, widened edge of the open lateral face of the spinning rotor 1. By way of a sealing element 31 with a connecting flange 32, the suction duct 29 adjoins a corresponding flange 33 of an exhaust air duct 34 fixedly arranged on the spinning unit. The subatmospheric pressure necessary to effect fiber transport from the opening roll 18 via the fiber supply duct 11 to the slide surface, conically widening with respect to the largest diameter of the spinning rotor, representing a fiber-collecting groove, is produced inside of the spinning rotor 1 by way of said exhaust air duct 34 and the suction duct 29.

Figure 2:
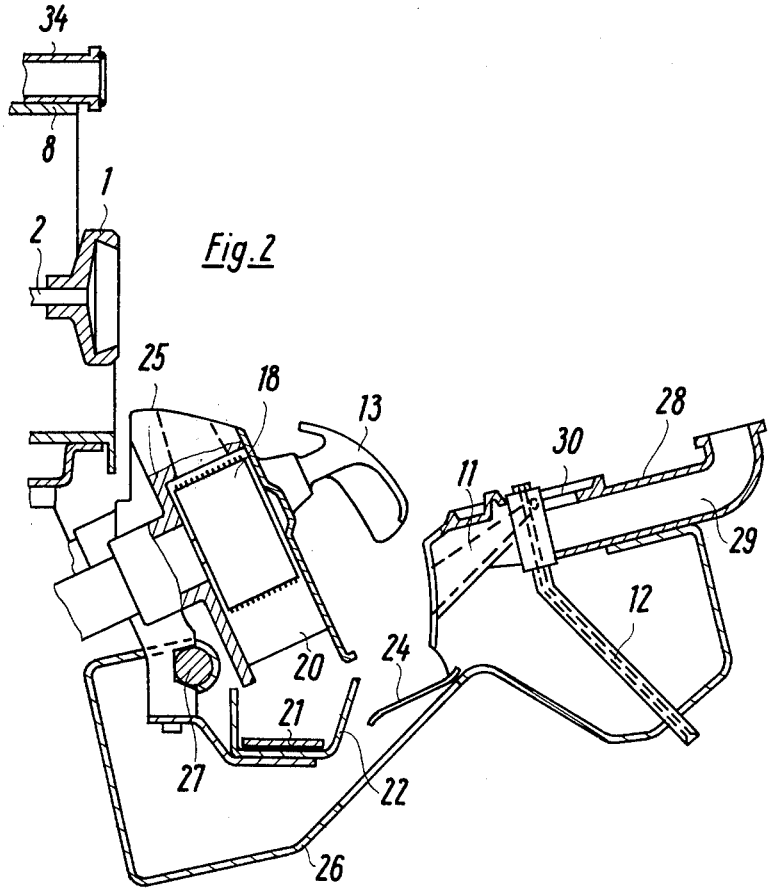
FIG. 2 is a partial schematic sectional view which shows the spinning unit of FIG. 1 in an opened condition.

It can be seen from FIG. 2 that the area of the spinning rotor is completely exposed after the cover 26 has been swung out, because the closing component 28 and also the suction duct 29 have been removed from the area of the spinning rotor 1. The housing duct, consisting of the C-shaped profile 8 and containing the bearing and drive elements for the spinning rotor, is very easily accessible in this manner, so that all of the components located therein can be serviced or, if need be, repaired or exchanged. Especially, it is possible to install a new tangential belt 5 in a very simple and convenient manner, since this operation is not hindered by a rotor housing or like component. In the opened state shown in FIG. 2 the exhaust air duct 34 of the spinning unit is also accessible in such a manner that a corresponding connection of a mobile service apparatus can be joined, for example, to this spinning unit, so that, for instance, the service apparatus can carry out cleaning operations with the aid of air suction without having to be equipped with an indraft source itself.

The elimination of a rotor housing results in considerable advantages, not only with respect to accessibility and service of the drive and bearing devices of the spinning rotor 1, but also with reference to the possibility of bringing the rotor substantially closer to the pairs of supporting disks facing this rotor, so that the shaft with the rotor overhangs these supporting disks much less far than must the shaft in the presently employed supporting disk bearings wherein the rear wall of the rotor housing must be available in this area.

The direct actuation of the interior chamber of the spinning rotor 1 with a vacuum (subatmospheric pressure) also results in the advantage that the power required for the generation of subatmospheric pressure is, in total, less than in open-end spinning machines in which the rotor housings surrounding the spinning rotors also have to be subjected to subatmospheric pressure, since the volume magnitude of the chambers actuated with a vacuum is reduced. Additionally, there is the advantage that the magnitude of the vacuum inside of the individual spinning rotors 1 can be maintained at uniform values with considerably more preciseness, so that more uniform spinning conditions result over the entire open-end spinning machine. In this context, it is also contemplated to construct the connections between the exhaust air duct 34 and the suction duct 29 in such a fashion that the exhaust air duct 34 is automatically closed with sealing action when the cover 26 and thus the closing component 28 are moved away from the open-end spinning rotor. In this connection, a flap mechanism can be provided which automatically reopens when the suction duct is brought into its operating position represented in FIG. 1.

Care must be taken that the air flowing from the orifice of the fiber supply duct 11 to the orifice 30 of the suction duct 29 is maximally adapted to the inner slide wall of the spinning rotor 1, so that the concomitantly transported fibers are reliably deposited on the slide wall, in order to make sure that the fibers are uniformly distributed and deposited in the fiber-collecting groove of the spinning rotor as parallel as possible and are not drawn off by suction via the suction duct 29. This means that it must be prevented that the air exiting the fiber supply duct 11 be directly diverted to the orifice of the suction duct. Instead, it must be achieved that the air stream first flow radially toward the slide wall and then axially along the slide wall toward the outside. For this reason the orifice of the fiber supply duct 11 and the orifice 30 of the suction duct 29 must have a sufficiently large spacing in a peripheral direction, i.e. primarily in the direction of rotation of the spinning rotor 1. Besides, it is provided that the orifice 30 of the suction duct 29 is located in closer proximity to the slide surface of the spinning rotor 1 than the orifice of the fiber supply duct, so that, at any rate, the air current exiting from the fiber supply duct first must proceed in a radial direction toward the slide wall of the spinning rotor 1 before this air current is deflected toward the outside. Further, it is then provided that the orifice 30 of the suction duct 29 is located further out in an axial direction of the spinning rotor 1, i.e. closer to the open lateral face, so that the air exiting from the fiber supply duct 11 is conveyed along the slide wall of the spinning rotor 1 in an axial direction. The means to guide the air flow inside of the spinning rotor according to preferred embodiments of the invention are described in greater detail in connection with FIGS. 3 through 15. In FIGS. 3 through 15 and in the corresponding depiction, letter suffixes are added to the reference numerals so as to depict the different respective configuration by different reference characters.

Figure 3:
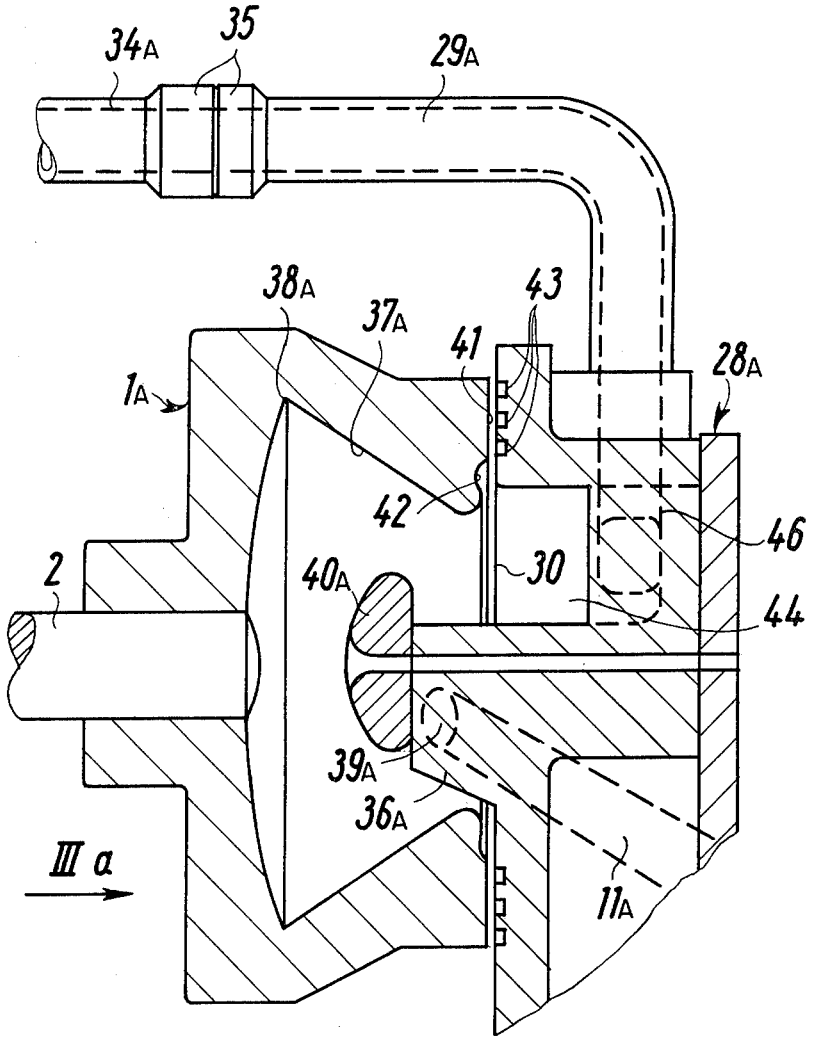
FIG. 3 is an enlarged sectional side view of a preferred embodiment of a rotor and closing component construction for use with a spinning unit as shown schematically in FIGS. 1 and 2.

In the embodiment according to FIG. 3, the closing component 28A is equipped with a suction duct 29A formed preferably as a flexible hose. This suction duct is connected to the exhaust air duct 34A by way of sleeves 35. The closing component 28A projects into the inner chamber of the spinning rotor 1 with a hub-shaped component 36A. The orifice 39A of the fiber supply duct 11A is located opposite of the slide wall 37A of the spinning rotor, which slide wall extends from the fiber-collecting groove 38A to the open lateral face of the spinning rotor 1A and becomes conically narrower in the process. A mushroom-shaped top 40A projects even further into the inner chamber of the spinning rotor 1A; this top is inserted into the closing component 28A coaxially with respect to the shaft 2A of the spinning rotor and is formed as a so-called thread take-off nozzle through which the spun thread is taken off. This mushroom-shaped top is preferably made of ceramic material, for instance. The orifice 30A of the suction duct 29A is located approximately in the plane of the open lateral face of the spinning rotor. The spinning rotor 1A has a widened open edge 41 and is provided with a channel 42 extending all around in the area adjoining the slide surface 37A; which channel merges into the slide wall 37A with a rounded portion. The closing component 28A forms a flange located opposite of the edge 41 having a surface which extends radially with respect to the rotor axle. This flange is provided with continuous grooves 43, so that a sort of labyrinth seal is created in the sealing gap between the closing component 28A and the rotor edge 41.

Figure 3A:
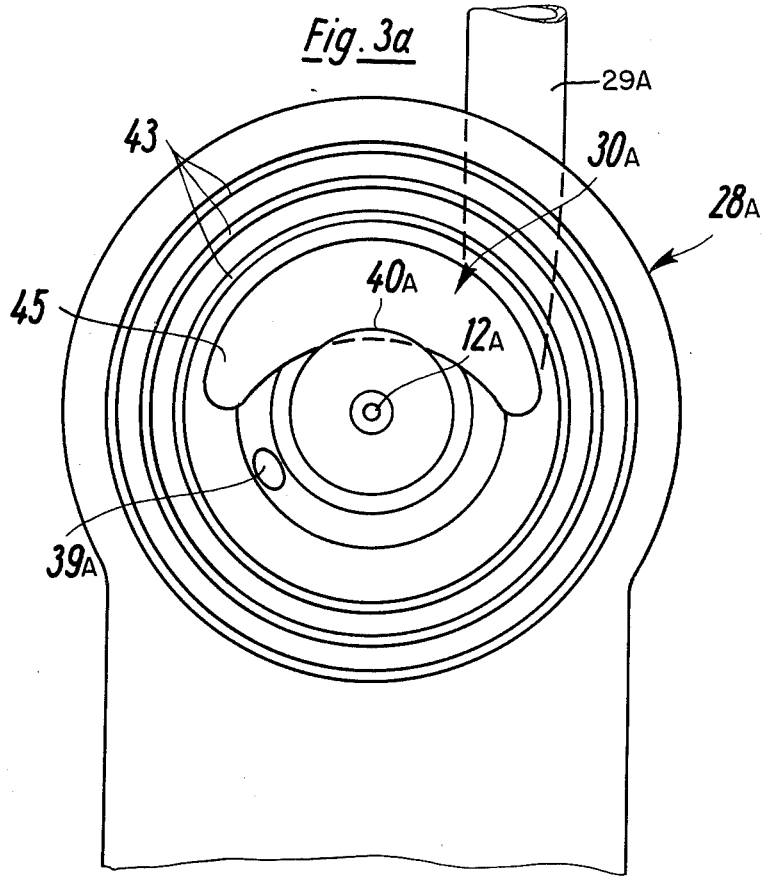
FIG. 3*a* is a plan view of the closing component of the FIG. 3 construction, taken in the direction of arrow IIIa of FIG. 3.

As can be seen from FIG. 3*a*, depicting a view of the closing component 28A in the direction of the arrow IIIa, the orifice 30A of the suction duct 29A has an approximately reniform cross section with which this orifice is located opposite of the open lateral face of the spinning rotor 1A. For this purpose, a recess 44 of approximately rectangular form is worked into the closing component 28A. This recess gradually increases in height from the end 45 adjacent the orifice 39A of the fiber supply duct 11A until it reaches the height indicated in FIG. 3 by the dashed line 46. The hose 29A acting as the suction duct then adjoins in this area, i.e. in the area located furthest from the orifice 39A of the fiber supply duct 11A. Thus the effect is, to an even greater extent, that the air current does not have to make any abrupt changes in direction, which could cause the fibers to follow this changed direction, before the air current reaches the slide wall 37A of the spinning rotor. As can be further seen from FIGS. 3 and 3*a*, the suction duct 29A has a cross section amounting, at least in its initial area, to many times the magnitude of the cross section of the orifice 39A of the fiber supply duct 11A, so that the quantity of air flowing into the spinning rotor via the fiber supply duct can flow out at a reduced velocity.

Figure 4:
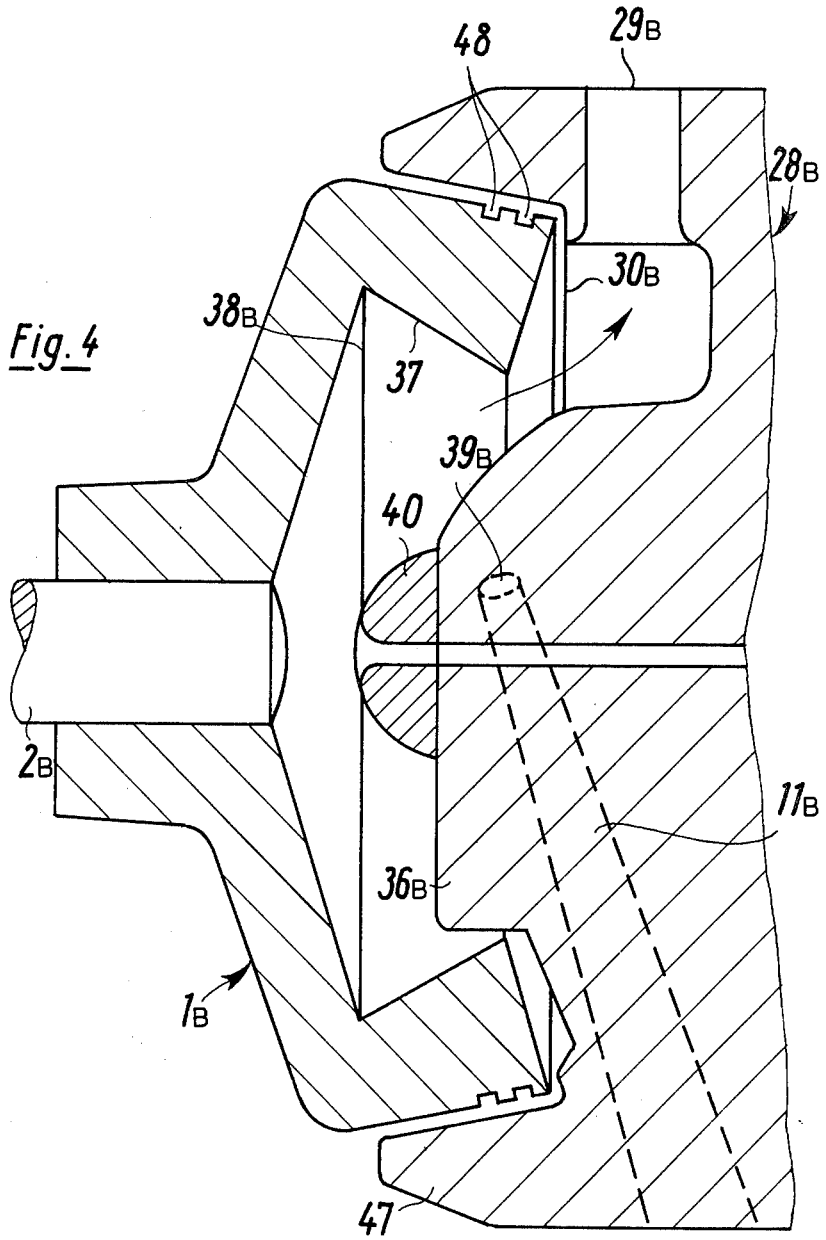
FIGS. 4 to 14 are respective enlarged sectional side views of further preferred embodiments of rotor and closing component constructions for use with a spinning unit as shown schematically in FIGS. 1 and 2.

In the embodiment according to FIG. 4, the spinning rotor 1B has, in total, a larger diameter than in the embodiment according to FIG. 3. In this embodiment, the closing component 28B projects with it hub-like component 36B and with the mushroom-shaped top 40B deeper into the spinning rotor, wherein the mushroom-shaped top with the thread take-off nozzle is arranged approximately in the radial plane formed by the fiber-collecting groove 38B. The closing component 28B embrances the conical exterior of the spinning rotor 1B with an annular shoulder 47. The exterior is provided with annular grooves 48 to create a sort of labyrinth seal in the sealing gap formed between the shoulder 47 and the exterior of the spinning rotor. The conical shape of the shoulder 47 and the exterior surface of the spinning rotor 1B has the advantage that the closing component 28B can be simply swung out about a pivot axle located beneath the spinning rotor 1B at a spacing.

In the embodiment according to FIG. 4, the orifice 30B of the suction duct 29B is mostly located opposite of the edge of the spinning rotor 1B, which edge declines slightly inwardly and has the approximately inclination of the bottom of the spinning rotor. The hub-shaped component 36B of the closing component has a flattened portion in the area of the orifice 30B of the suction duct 29B, which orifice only extends in part beyond the inner chamber of the spinning rotor 1B. In that way a sufficient flow cross section is present for the air current to be guided from the orifice 39B of the fiber supply duct 11B to the suction duct 29B. The orifice 30B of the suction duct, which orifice is located further outward, causes the air stream here to receive a flow direction which is also first directed radially with respect to the slide wall 37B and subsequently axially flowing along said slide wall after the air current has left the fiber supply duct 11B in addition to the flow direction extending in the peripheral direction of the spinning rotor.

The annular grooves 48 can have a spiral shape on the periphery of the spinning rotor, so that they cause an air feed exerting an axial force on the rotor 1B and the shaft 2B. This can be advantageous, since in this construction, the subatmospheric pressure has an effect on only one side of the spinning rotor 1B, so that the latter is stressed due to the subatmospheric pressure with an axial force which tries to move this spinning rotor away from its footstep bearing 7 (FIG. 1). In this connection, the forces exerted by the spiral grooves can provide compensation.

Figure 5:
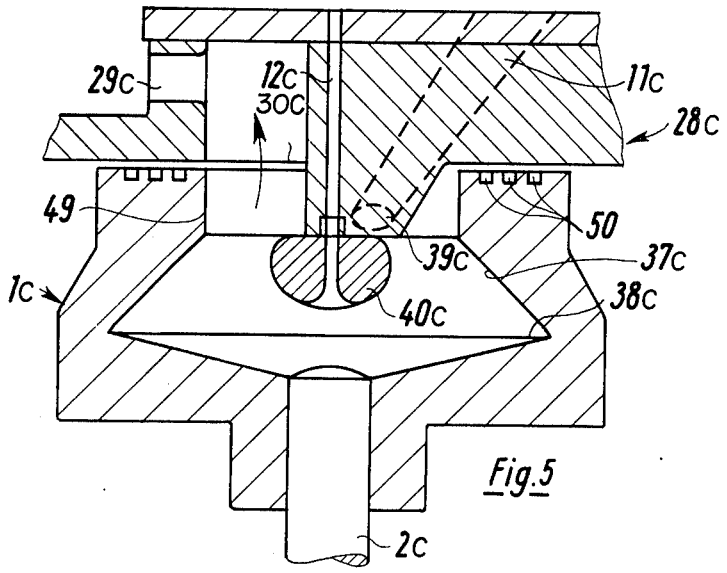

With reference to the closing component 28C, the embodiment according to FIG. 5 essentially corresponds to the embodiment according to FIG. 3. In the embodiment according to FIG. 5, the spinning rotor 1C has a cylindrical surface 49 which adjoins the conical fiber slide surface 37C, which is directed toward the fiber supply duct 11C, this surface 49 extending to the open side. In this construction, a sealing gap also is provided between a surface of the closing component 28C, which surface extends radially with respect to the rotor axle, and the edge of the spinning rotor 1C, which edge likewise extends radially with respect to the rotor axle, as well. In constrast to the embodiment according to FIG. 3, annular grooves 50 are arranged in the edge of the spinning rotor in this embodiment.

Figure 6:
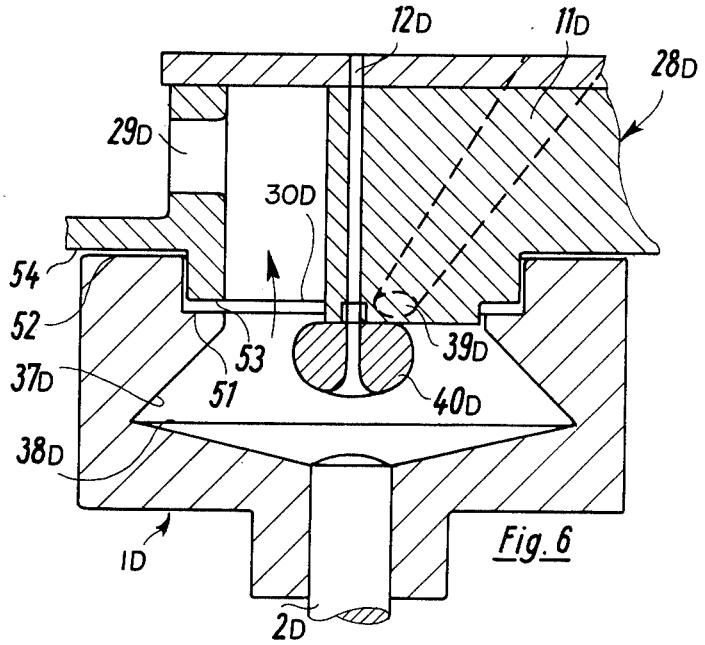

The embodiment according to FIG. 6 differs from the embodiment according to FIG. 3 essentially just by the structure of the sealing gap between the spinning rotor 1D and the closing component 28D, mounted, for instance, on swivel arms and capable of being moved away. In this embodiment, the edge of the spinning rotor 1D is provided with two radial surfaces 51 and 52 which extend in the form of a step; opposite these surfaces are located correspondingly stepped surfaces 53 and 54 of the closing component in order to form a sealing gap.

Since in the embodiments according to FIGS. 3, 5 and 6, the sealing surfaces between the spinning rotor and the closing component extend in a radial direction with respect to the axis of rotation of the spinning rotor, the penetration depth of the closing component and, primarily the mushroom-shaped top into the spinning rotor cannot be adjusted. If the position of the mushroom-shaped top with respect to the fiber-collecting groove is to be changed in order to influence spinning conditions, then this is readily possible by exchanging the mushroom-shaped top for a top with correspondingly longer dimensions in an axial direction.

Figure 7:
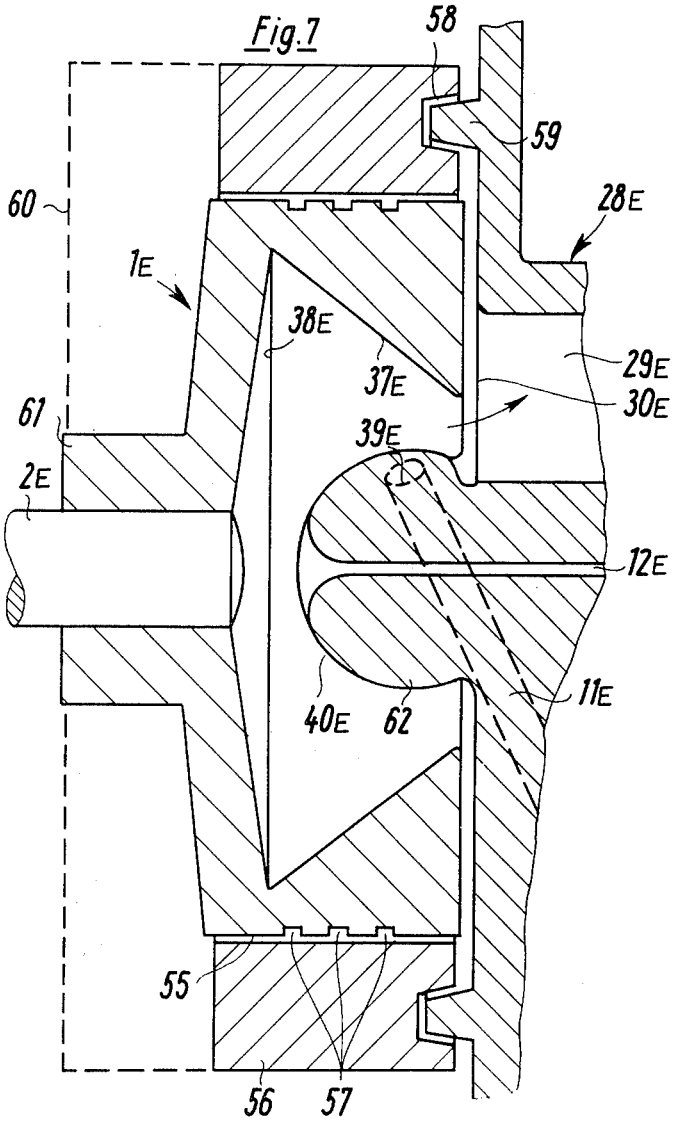

In the embodiment according to FIG. 7, the spinning rotor 1E, provided with a cylindrical outer jacket 55, is surrounded by a fixedly arranged ring 56 forming a sealing gap with the outer jacket 55. In the embodiment illustrated, the outer jacket 55 of the spinning rotor has annular grooves 57 in order to form a kind of labyrinth seal. Of course, annular grooves can also be arranged on the interior surface of the stationary ring 56 in a suitable manner. In this construction, the closing component 28E enclosing the spinning rotor 1E and containing a fiber supply duct 11E, a thread take-off duct 12E, and an air suction duct 29E with an orifice 30E is sealed off against the stationary ring 56. For this purpose the stationary ring has an annular groove 58 defined by conical walls; a continuous fin 59 adapted to the shape of this annular groove 58 projects into this groove. In this construction, the spinning rotor with its shaft 2E can be adjusted in an axial direction relative to the closing component 28E, for example, to influence spinning conditons, without thereby affecting the sealing action.

As is indicated in dashed lines in FIG. 7, the stationary ring can be supplemented to complete a housing 60 forming another sealing gap with a collar 61 of the rotor plate, so that an additional subatmospheric pressure chamber results between the rear wall of the spinning rotor 1E and the housing 60, whereby the axial thrust possibly induced by the subatmospheric pressure can be alleviated.

In the embodiment according to FIG. 7, the element 62, projecting into the spinning rotor 1E, of the closing component 28E has a rotationally symmetrical shape corresponding to approximately two thirds of a sphere. The orifice 30E of the suction duct 29E is located with about half of its cross section radially beyond the rotor edge and thus projects beyond the interior chamber of the rotor only with approximately half of its dimension.

Figure 8:
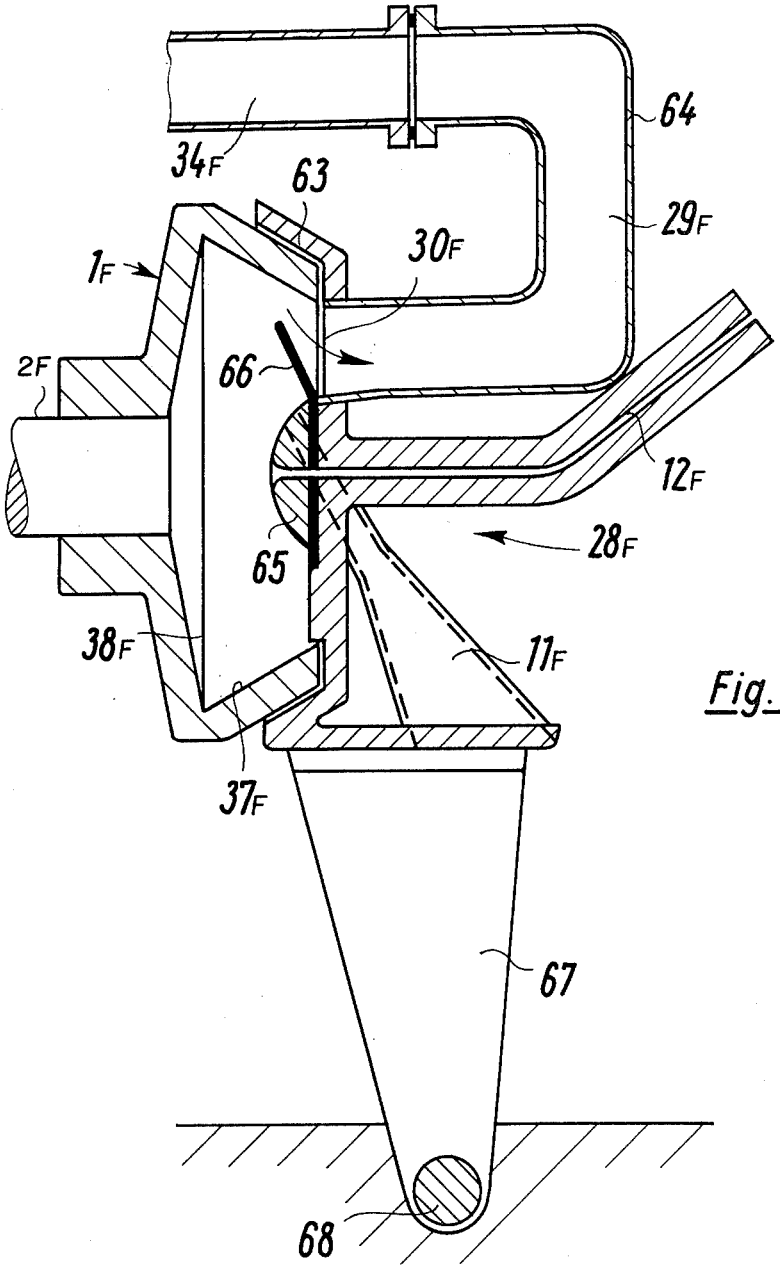

The embodiment according to FIG. 8 provides an open-end spinning rotor 1F which does not differ from presently conventional spinning rotors on account of its inner and outer contour, which conventional spinning rotors are arranged in a subatmospheric pressure housing and in which the transport air effecting fiber transport to the spinning rotors is drawn off by suction via the edge of the open lateral face. The spinning rotor has a closed bottom gradually increasing to a fiber-collecting groove 38F; a fiber slide surface 37E conically tapering toward the open lateral face is connected to this bottom; the orifice of the fiber supply duct 11F is located opposite this fiber slide surface. Associated with the spinning rotor 1F is a closing component 28F shaped in the manner of a plate and embracing the outwardly conically tapering spinning rotor 1F with a conically widened edge 63. A pipe 64 is adapted to fit into the plate base; this pipe forms a suction duct 29F which is in connection with the interior chamber of the spinning rotor 1F via an orifice 30F and adjoins an exhaust air duct 34F of the open-end spinning unit. In this context, the pipe 64 with its orifice 30F is located in such a position that the orifice is located completely over the open lateral face of the spinning rotor. The pipe 64 can be profiled in the area of its orifice, so that the orifice has a specific cross sectional shape, especially the shape of a kidney extending in the peripheral direction of the spinning rotor or the shape of an annular segment. The plate-like closing component 28F receives a fiber supply duct 11F shaped in the form of a conically tapering pipe which penetrates the plate bottom and is directed toward the fiber slide wall 37F of the spinning rotor 1F. A yarn take-off duct 12F is integrally molded on the plate bottom; a thread take-off nozzle 65, facing the spinning rotor, on the interior is associated with this yarn take-off duct.

A guide disk 66 is held by means of the preferably threadedly joined thread take-off nozzle 65; this guide disk has a slight bend into the spinning rotor and in this area has an approximately crescent-shaped form with which it comes to rest before the orifice 30F of the air suction duct. The flow forming in the interior of the spinning rotor 1F can be influenced with the aid of this guide disk and this flow can optionally diverted even more than usual toward the fiber slide surface 37F. But a primary object of the guide disk 66 is to guide the thread end to be returned into the spinning rotor via the yarn take-off duct 12F as closely as possible to the slide surface 37F of the spinning rotor 1F and to prevent the thread end from being drawn into the suction duct 29F during the piecing process and thus from not reaching the spinning rotor and, particularly, the fiber-collecting groove 38F. In this context, the guide disk 66 can be pivotally arranged on the connection component 28F and connected to an adjusting mechanism by which this component can be rotated in a peripheral direction in such a way that, if need be, this component more or less overlaps the orifice 30F of the suction duct 29F, i.e. only during a piecing operation and not during the normal spinning process.

The closing component 28F is mounted on a swivel arm 67 which is pivotable about a swivel axle 68 in such a way that the closing component 28F together with the suction duct 29F is moved away from the spinning rotor 1F, so that the latter is exposed for a service operation or like process. Despite the pivotability, the conical external contour of the spinning rotor 1 and the annular shoulder 63F permits a mutual approach in relatively close proximity, especially when the pivot axle 68F is located relatively near a radial surface extending through the spinning rotor.

Figure 9:
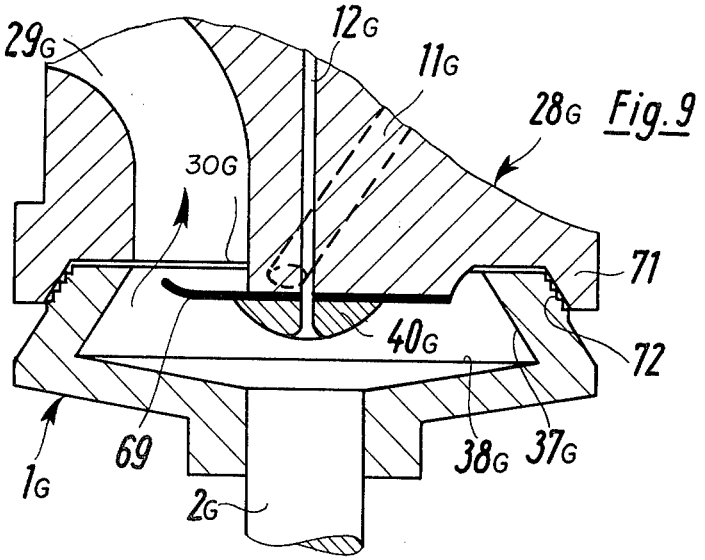
Figure 10:
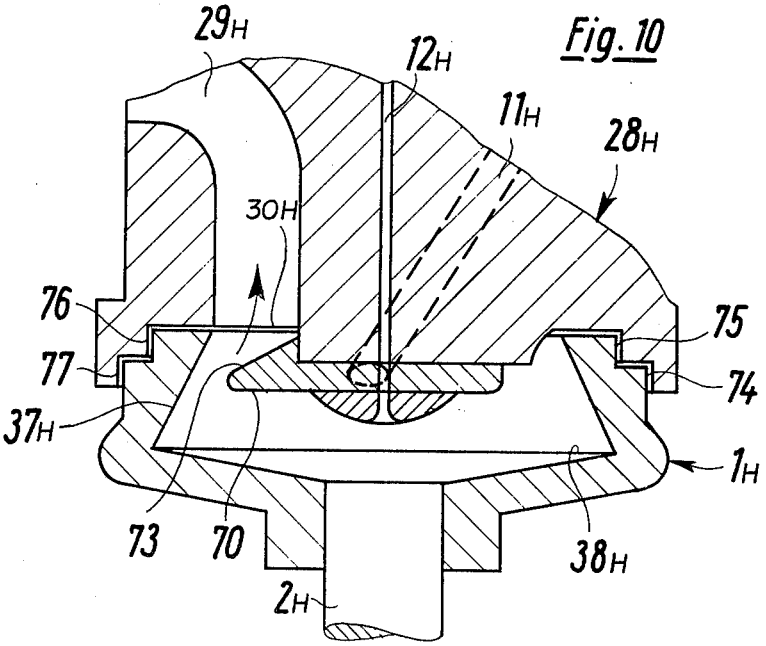

In the embodiment according to FIGS. 9 and 10, guide elements 69 and 70 are provided, which are to have similar functions as the deflector 66 of FIG. 8. In FIG. 9, the connection component 28G having a fiber supply duct 11G and a thread take-off duct 12G as well as a suction duct 29G surrounds the conical exterior surface of the open-end spinning rotor with a conical shoulder edge 71. This exterior surface has a rough surface 72 or like surface of attain an even greater sealing action here. A deflector 69 is also held here by a mushroom-like top 40G acting as a yarn take-off nozzle. This deflector 69 extends into the area of the orifice 30G of the suction duct 29G. Here the only essential object of this deflector 69 is also to prevent a thread needed for the piecing process from entering into the orifice 30G and the suction duct 29G. But it can also exert an influence on the flow direction of the air current as well. This deflector likwise has a preferably crescent-shaped form with which it partially overlaps the orifice 30G of the suction duct 29G proceeding from the middle of the closing component 28G.

The guide element employed in FIG. 10 essentially extends in a radial direction. In addition, it has a guide surface which faces the orifice 30H of the suction duct 29H and which imparts such a structure to the discharge opening, formed by the fiber slide wall 37H and this guide surface 73, that this discharge opening widens in the manner of a diffuser. Since, in this embodiment, the guide element 70 is penetrated by the fiber supply duct and also contains the orifice 39H of the fiber supply duct 11H, this guide element must be fixedly mounted.

In the embodiment according to FIG. 10, the spinning rotor is provided on its exterior with two stepped cylindrical surfaces 74 and 75 which are surrounded by correspondingly stepped cylindrical surfaces 76 and 77 of the closing component 28H, so that a stepped sealing gap is maintained. This construction offers the possibility that the spinning rotor 1H is adjustable to a certain extent in an axial direction with respect to the closing component 28H, without substantially impairing its capability of swinging outwardly, particularly when the cylindrical surfaces 74 through 77 are of relatively short dimensions. A stepped graduation with a larger number of cylindrical sealing surfaces can also be provided, according to yet further preferred embodiments.

In order to reduce the danger, in total, of the thread's being taken into the suction duct during a piecing operation, it can be provided that the air flow be reduced during the process of drawing in by suction. For example, for this purpose the flow resistance inside of the suction duct can be increased, which is relatively simple to effect, for instance, when the suction duct is embodied as an elastically compressible hose. It is also contemplated to provide, inside of the suction duct, a supply air opening which is additionally opened during the piecing operation, so that air can be drawn in by suction not only via the suction orifice, but also by way of the supply air opening.

In all of the aforedescribed embodiments of the invention, the suction duct is in connection with the interior of the open-end spinning rotor by way of an orifice located asymetrically with respect to the rotation axle of the spinning rotor and limited to only a specific area. Therefore, there is a preferred direction of air flow, limited to just a specific area.

Figure 11:
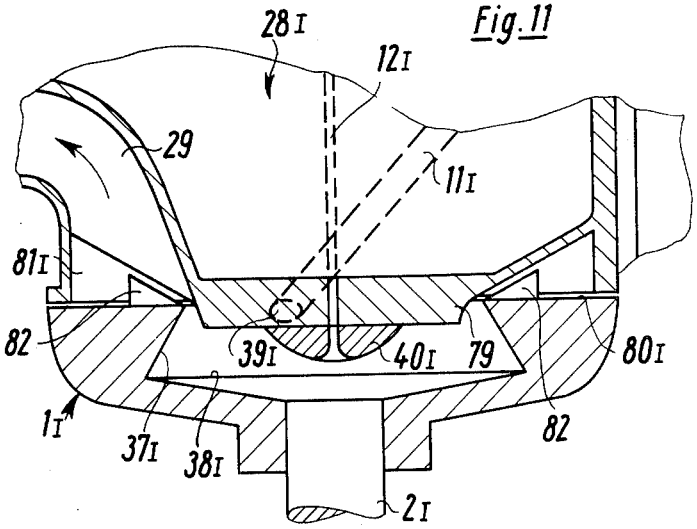
Figure 12:
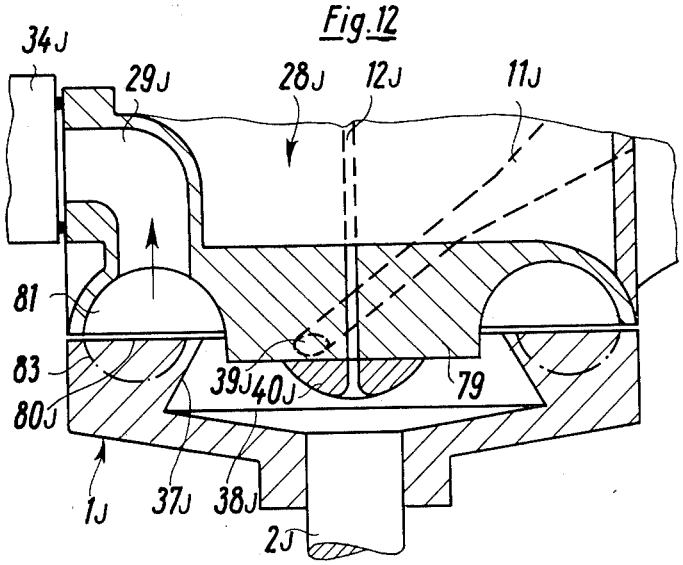
Figure 13:
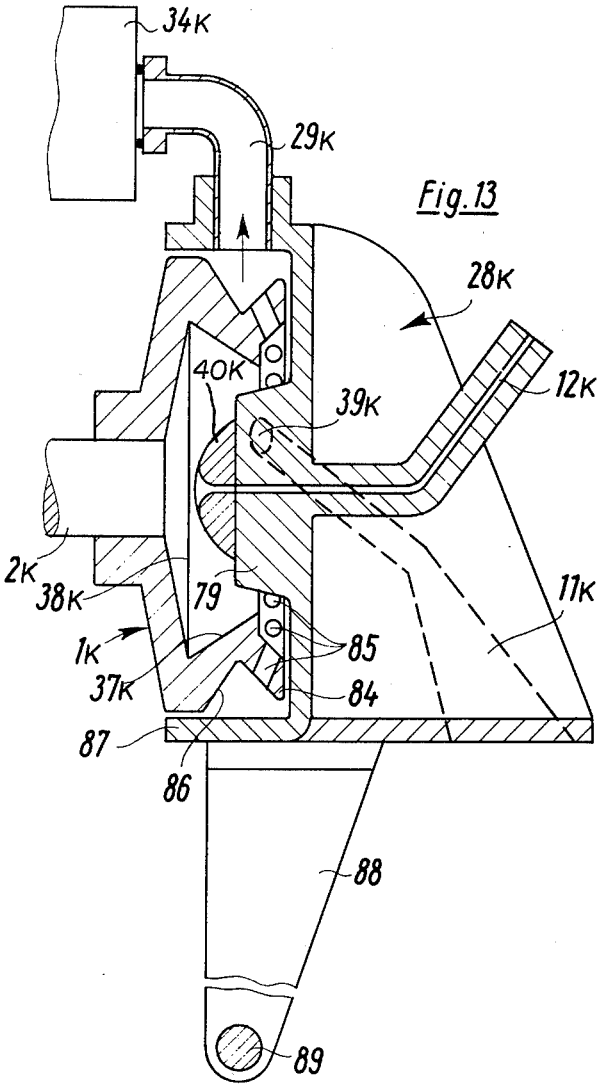
Figure 14:
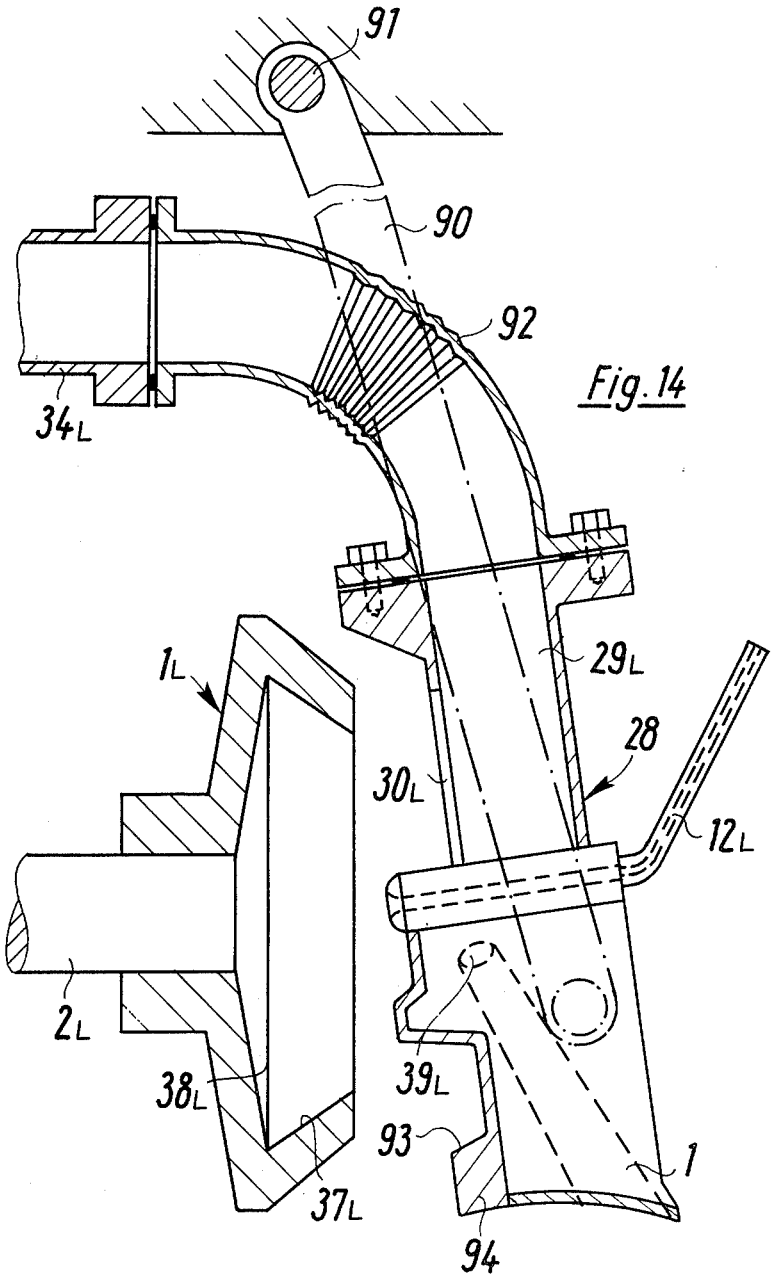

By contrast, in the embodiments according to FIGS. 11 through 13, the inner chamber of the spinning rotor is connected via a uniform annular gap to the sucton duct which is formed by its open lateral face and a hub-like, rotationally symmetrical shoulder 79I, 79J, 79K projecting into the spinning rotor. Above the edge 80I, 80J considerably widened in a radial direction, of the open-end spinning rotor, an annular duct 81I, 81J is created which is a component of the section, located opposite said edge of the closing component 28I, 28J, 28K. Then the suction duct adjoins this annular duct.

In the embodiment according to FIG. 11, the annular duct 81I has the form of a triangle, the apex of which faces the annular gap between the structural component 79I and the edge of the spinning rotor. Lugs 82 pointing in a radial direction are arranged on the edge 80I of the spinning rotor; these lugs extend radially or they can have a configuration curved in a peripheral direction and they can act as fan blades which convey air from the interior of the spinning rotor into the annular duct 81I. The annular duct 81I distributes the subatmospheric pressure supplied to the rotor by the suction duct 29I in a relatively uniform fashion over the periphery of the spinning rotor; this can be further supported especially by the lugs 82 of the embodiment according to FIG. 11. It is also contemplated to give the annular duct 81I a form of a spiral housing, which is usual, for instance, in radial blowers in order to maintain a uniform air feed.

In the embodiment according to FIG. 12, the annular duct 81J has a semicylindrical shape on account of the annular groove arranged in the closing component 28J. It is likewise possible to further enlarge the cross section of the annular duct 81J in that a similar annular groove is arranged in the widened edge 80J of the open-end spinning rotor 1J, as is indicated, for example, by the dot-dash lines 83 in FIG. 12.

Adjoining its fiber slide surface 37K, which tapers conically toward the open lateral face, the spinning rotor 1K in the embodiment according to FIG. 13 is provided with an edge 84 which widens toward the outside and which is equipped with ventilation bores 85 directed obliquely toward the outside. The exterior periphery of the spinning rotor has a continuous annular groove 86, in the area of which the ventilation bores 85 terminate. The area of the annular groove 86 of the spinning rotor is enclosed by a cylindrical extension 87 of the closing component 28K, to which latter a suction line 29K is attached which is connected with an exhaust air line 34K of the spinning unit. In this embodiment, as well, the air, which effects fiber transport via the fiber supply duct and which exits from the orifice 39K, is drawn off by suction in relatively uniform distribution over the periphery of the spinning rotor, and specifically, via an annular gap uniform over the entire periphery between the truncated cone-like component 79K of the closing component 28K and the end of the fiber slide surface 37K. The closing component 28K in this construction is mounted, capable of swiveling, on a pivot axle 89 with the aid of a holder 88 in such a way that the closing component can be swiveled away from the spinning rotor. In this context, the swivel axle 89 must be arranged at a maximum distance and, if possible, in a plane lying radially through the spinning rotor 1K; thus the closing component 28K moves as axially as possible with respect to the spinning rotor 1K at least in the initial area of the swinging out motion of this conponent.

The embodiment according to FIG. 14 again provides that the transport air is drawn off by suction from the spinning rotor 1L in an asymetrical manner. For this purpose, a closing component 28L, represented in its outwardly pivoted position, is provided and held pivotably about a swivel axle 91 with swivel arms 90. The closing component 28L has a take-off duct 29L which is in connection with the interior of the spinning rotor 1L by way of an orifice 30L when the closing component 28L is located in the position in which it closes the spinning rotor 1L. The suction duct 29L is connected with a stationary exhaust air duct 34L of the spinning unit via an elastic hose section 92, so that the connection between the exhaust air duct 34L and the suction duct is not interrupted by an outward pivoting motion of the closing component 28L.

The closing component 28L has an edged beading 94 possessing a conically widening inner surface 93; this edged beading is associated with the conically tapering outer surface of the spinning rotor 1L and forms a sealing gap together with said outer surface.

Figure 15:
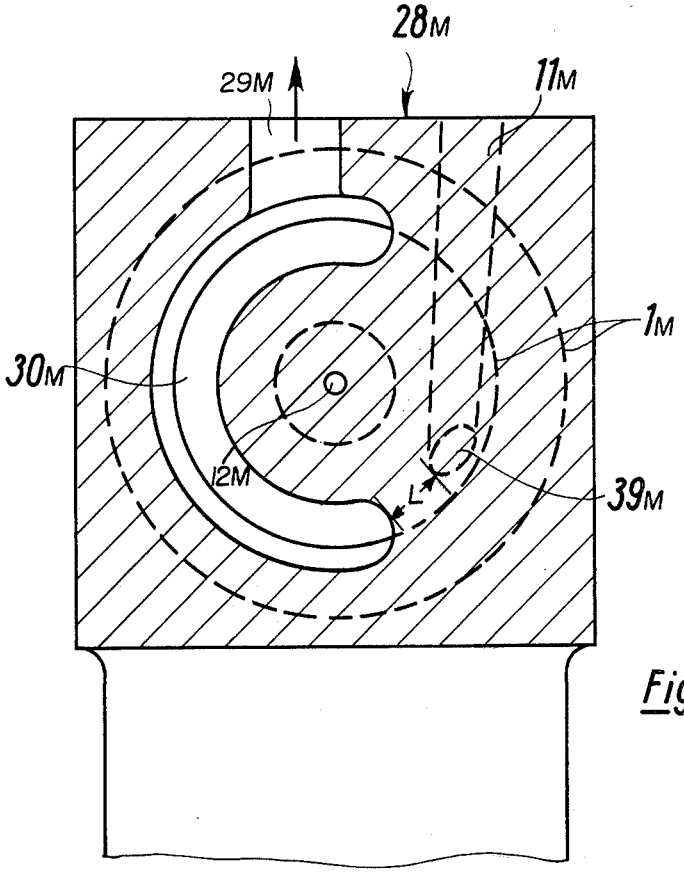
FIG. 15 is a sectional schematic view of a closing component constructed in accordance with a preferred embodiment of the invention, in a plane radial with respect to an associated rotor axle.

FIG. 15 represents a section through a closing component 28M, approximately corresponding to the closing component according to FIG. 4. The suction duct 29M has an orifice 30M possessing the form of an annular segment extending concentrically with respect to the rotor axle. This orifice begins at a spacing L from the orifice 39M of the fiber supply duct 11M, which corresponds, seen in a peripheral direction, at least to the middle staple length of the fiber material to be processed. It is expediently provided that the spacing L amounts to at least two staple lengths. The orifice extends beyond the edge of the open lateral face of the spinning rotor 1M (dash lines) with approximately one third of its radial extension.

It is further contemplated to provide closing elements for the suction orifices, which elements are capable of being displaced in the manner of a diaphragm. With these elements the extension of the suction orifices in a peripheral direction can be changed, i.e. with these elements the initial area of the orifice can be made to approach the area of the orifice of the fiber supply duct or can be distanced from said area. Thus the conditions for the formation of an air flow inside of the spinning rotor can be influenced.

A change in the length of the orifice 30 in a peripheral direction can be advantageous in order to be able to adapt and adjust it to the fiber material to be processed.

It is advantageous in all of the embodiments of the invention in which the orifice of the suction duct is located, entirely or partially, over the area of the inner chamber of the open-end spinning rotor, if the suction duct has in inclination in the area of the orifice in a peripheral direction of the spinning rotor, so that the air is drawn off by suction with a component extending approximately tangentially with respect to the spinning rotor, all of which is favorable for the behavior of the air flow and for the separation of the fibers. This can be achieved in the embodiment according to FIG. 15, for example, in that the height of the suction duct in the area of the orifice 30-seen vertically with respect to the plane of the drawing-constantly enlarges from the beginning of the orifice 30 in the area of the orifice 39 of the fiber supply duct 11 to the other end, so that in this way an air flow is maintained which necessarily moves obliquely upwardly in a peripheral direction of the spinning rotor. This "tangential direction" can also be maintained in that the pipe, adjoining the orifice 30 and forming the suction duct, obtains a corresponding inclination in a peripheral direction. This inclination can then be of the same magnitude as that of the fiber supply duct, wherein the two inclinations are directed in opposition with respect to the direction of rotation of the spinning rotor.

While we have shown and described several embodiments in accordance with the present invention, it is understood that the same is not limited thereto but is susceptible to numerous changes and modifications as known to those skilled in the art and we therefore do not wish to be limited to the details shown and described herein but intend to cover all such changes and modifications as are encompassed by the scope of the appended claims.

We claim:

1. Open-end spinning unit with a spinning rotor open on one side and having a closed bottom and closed lateral walls, the open side of which spinning rotor is covered with a closing component containing fiber supply means directed at a slide wall of the spinning rotor, a yarn take-off duct, and a suction duct, wherein the suction duct includes an orifice opening into the spinning rotor, at least part of said orifice being disposed in the radial direction of the rotor closer to the slide wall than to the fiber supply means.

2. Open-end spinning unit according to claim 1, wherein the orifice is located closer in an axial direction of the spinning rotor to the open lateral face of the spinning rotor than to the end of the fiber supply means which opens into the rotor.

3. Open-end spinning unit according to claim 1 or 2, wherein the suction duct extends at least approximately tangentially with respect to the spinning rotor as seen in the plan view of the open lateral face of the spinning rotor.

4. Open-end spinning unit according to claim 1 or 2, wherein the suction duct is inclined away from the spinning rotor in the direction of operation of said spinning rotor.

5. Open-end spinning unit according to claim 1, wherein the orifice of the suction duct is formed as an annular chamber which is concentric with respect to the rotational axis of the spinning rotor.

6. Open-end spinning unit according to claim 5, wherein the annular chamber is in connection with the inner chamber of the spinning rotor by way of an annular gap which is formed by the edge defining the open lateral face of the spinning rotor and a rotationally symmetrically formed extension of the closing component.

7. Open-end spinning unit according to claim 5 or 6, wherein the edge associated with the annular duct of the spinning rotor is provided with air-conveying elements.

8. Open-end spinning unit according to claim 1, wherein the orifice of the suction duct radially overlaps in part the edge of the open lateral face of the spinning rotor.

9. Open-end spinning unit according to claim 1, wherein the orifice of the suction duct has a cross-section with an approximately kidney-shaped curve in a peripheral direction of the spinning rotor.

10. Open-end spinning unit according to claim 1, wherein the orifice of the suction duct is formed as a section of a ring, which section extends in a peripheral direction of the spinning rotor.

11. Open-end spinning unit according to claim 1, wherein the orifice of the suction duct has the shape of a section of a spiral preferably increasing in the direction of rotation of the spinning rotor.

12. Open-end spinning unit according to any of claims 8 through 11, wherein the orifice of the suction duct is provided with covers for selectively adjusting the orifice cross section preferably in the manner of a diaphragm.

13. Open-end spinning unit according to claim 1, wherein the closing component is held by means of guide elements in a manner such that said component is capable of being moved away from the spinning rotor.

14. Open-end spinning unit according to claim 13, wherein the suction duct is joined to an exhaust air duct of the spinning unit with an elastic hose.

15. Open-end spinning unit according to claim 13, wherein the suction duct of the closing component is connected to an exhaust air duct of the spinning unit with the aid of readily detachable connection.

16. Open-end spinning unit according to claim 15, wherein one of the suction duct and the exhaust air duct of the spinning unit is provided with a connection for a suction line of a service apparatus.

17. Open-end spinning unit according to claim 1, wherein the closing component forms a sealing gap with the edge of the open lateral face of the spinning rotor.

18. Open-end spinning unit according to claim 17, wherein the open edge of the spinning rotor and/or the oppositely lying surface of the closing component is profiled to facilitate sealing.

19. Open-end spinning unit according to claim 18, wherein the closing component surrounds the edge of the spinning rotor.

20. Open-end spinning unit according to claim 19, wherein the spinning rotor includes a jacket, and wherein the jacket of spinning rotor is rough or profiled in the area surrounded by the closing component.

21. Open-end spinning unit according to claim 20, wherein the spinning rotor is provided with air-conveying elements which are effective in an axial direction.

22. Open-end spinning unit according to claim 21, wherein the closing component surrounds the conical rotor jacket with an extension having a conical inner surface.

23. Open-end spinning unit according to claim 1, wherein the spinning rotor is enclosed with sealing action with a stationary ring which latter is contacted with sealing action by the closing component.

24. Open-end spinning unit according to claim 23, wherein there is a sealing gap, formed by surfaces cylindrical with respect to the axis of rotation, between the ring and the spinning rotor.

25. Open-end spinning unit according to claim 1, wherein a preferably adjustable guide element is provided between the orifice of the suction duct and the orifice of the fiber supply duct.

26. Open-end spinning unit according to claim 25, wherein the guide element is rotatably arranged about an axis located in an extension of the rotor axle.

27. Open-end spinning unit according to claim 1, wherein a thread guide element, which is preferably adjustable and which partially covers the orifice of the suction duct, is arranged between the orifice of the suction duct and the yarn take-off duct.

28. Open-end spinning unit according to claim 1, wherein the suction duct is provided with means for selectively reducing the amount of air taken in by suction.

29. Open-end spinning unit according to claim 1, wherein the cross section area of the orifice of the suction duct is several times greater than the cross-section area of the orifice of the fiber supply duct.

30. Open-end spinning unit according to claim 1, wherein the orifices of the fiber supply duct and of the suction duct are in an arrangement staggered in the peripheral direction of the spinning rotor.

31. Open-end spinning unit according to claim 1, wherein the spinning rotor is mounted inside of a housing which is open toward the closing component and which contains the drive and bearing elements of the spinning rotor, and preferably is duct-like.

* * * * *